United States Patent [19]

McDonald

[11] Patent Number: 4,793,083

[45] Date of Patent: Dec. 27, 1988

[54] SIGN HOLDER

[76] Inventor: Angus E. McDonald, 147 Hyland Drive, Sudbury, Ontario, Canada, P3E 1R7

[21] Appl. No.: 923,267

[22] Filed: Oct. 27, 1986

[51] Int. Cl.[4] ..... G09F 15/00

[52] U.S. Cl. ..... 40/607; 40/299; 40/606; 40/611; 248/449

[58] Field of Search ..... 40/606, 489, 607, 611, 40/612, 10 R; 248/451, 450, 449, 448, 447.2, 441.1

[56] References Cited

U.S. PATENT DOCUMENTS

| | | | |
|---|---|---|---|
| 278,116 | 5/1883 | Fisher | 248/449 |
| 727,065 | 5/1903 | Benham | 40/607 |
| 1,918,571 | 7/1933 | Sheras | 40/607 |
| 2,552,745 | 5/1951 | Stanley, Sr. et al. | 40/607 |
| 3,058,246 | 10/1962 | Schoeffler | 40/607 |
| 3,231,230 | 1/1966 | Mueller | 248/449 |
| 3,738,606 | 6/1973 | Millen | 248/449 |
| 4,042,203 | 8/1977 | Warkentin | 248/449 |
| 4,233,769 | 11/1980 | Archer | 40/607 |
| 4,262,439 | 4/1981 | Dinan et al. | 40/607 |

FOREIGN PATENT DOCUMENTS

| | | | |
|---|---|---|---|
| 0028662 | 5/1981 | European Pat. Off. | 40/607 |
| 153336 | 6/1932 | Switzerland | 40/607 |

*Primary Examiner*—Gene Mancene
*Assistant Examiner*—J. R. Hakomaki
*Attorney, Agent, or Firm*—Stevens, Davis, Miller & Mosher

[57] ABSTRACT

A sign panel holding system of the type used by real estate agents or the like, comprising a normally upright post and two holding members securable to a post at virtually any point of the overall length thereof. The holders are each provided with at least one but preferably two parallel transverse members defining a pair of parallel slots. The lower holder has the slots turned upwardly to engage lowermost edges of a pair of normally generally rectangular panels. The upper holder is positioned upside down and is slideably adjusted along the post to grip the top edges of the panel to thus secure the panels fixedly to the associated post. The advance in the art is particularly in structural simplicity of the device and in its versatile use with panels of different size. The invention also allows the placement of the panels at selectively different levels of the post.

4 Claims, 1 Drawing Sheet

SIGN HOLDER

BACKGROUND OF THE INVENTION

The present invention relates to the art of display panel mounting systems and in particular to the display panel mounting systems such as the display panels used by real estate agents to mark a particular property as being for sale.

Many different mounting systems for purposes such as referred to above are well known. One system utilizes a normally generally vertical pole to which is secured at the top a transverse pole. To the transverse pole is panel holding the appropriate advertising material. The panel is usually provided with appropriate information on both surfaces thereof. While in many instances these panel mounting systems are attractive in appearance, they suffer from practical drawbacks particularly for being susceptible to damage in windy weather. The panels are relatively easy to become damaged by playing children. The system is difficult to transport and to properly set up. It is also relatively expensive to produce.

Another known system for holding display standards is shown in U.S. Pat. No. 2,345,943 issued Apr. 4, 1944 to Bishop and describing a two-way display standard held between two upright posts. The arrangement, while suitable for certain types of application, would not be useful for application outdoors as it requires at least two upright standards to be somehow anchored to the ground parallel with each other. Besides, it is limited to a particular combination of the standards and of the board.

U.S. Pat. No. Des. 213,607 issued Mar. 18, 1969 to Grady describes an arrangement of upright and horizontal members combining to form a system of rectangular frames each holding a display panel. The display panel is held around its periphery which means that the panel and the frame have to be exactly matched to each other. The drawback from the standpoint of the present invention is in relative lack of versatility. Besides, there is need for two posts to be anchored to the ground. The production cost is also relatively high.

Virtually the same drawback is present in the known sign board rack described in U.S. Pat. No. 4,559,733 issued Dec. 24, 1985 to Forslund. A complex arrangement of a display unit combined with socket mounted members is shown in U.S. Pat. No. 3,978,631 granted Sept. 7, 1976 to Diersing. This arrangement is extremely complex and relatively difficult to assemble. It holds the display panels by engaging their edges. There is no possibility of adjustment of the mounting arrangement to different widths of the panels which is given by the size of the sockets. Another arrangement of similar type is displayed in U.S. Pat. No. 3,415,519 issued Dec. 10, 1968 to Hand disclosing a portable target panel held by its side edges. As in the previous case, there is no adjustability to different sizes of the panels.

Another group of known prior art is capable of mounting sides of different size by placing same into a normally generally horizontal slot. The common drawback of these arrangements is that, regardless whether a single panel or a pair of panels is mounted, they are all mounted only along a bottom horizontal edge. The mount is therefore only suitable for certain environments, particularly those where the sign is not exposed to mechanical stresses such as those caused by wind or the like. A typical example of the signs of this type include U.S. Pat. No. 1,400,564 issued Dec. 20, 1921 to Metzger or U.S. Pat. No. 4,387,520 issued June 14, 1983 to Ahrens and also U.S. Pat. No. 1,915,762 issued June 27, 1933 to Rost, all of which only have a panel engaging slot at the bottom.

SUMMARY OF THE INVENTION

It is an object of the present invention to provide a display panel mounting system generally of the type as referred to above which would be of a simple structure and which would substantially enhance the versatility of the mount by allowing the same system to mount not only panels of different sizes but also to mount the panels at slightly adjustable levels along the support post.

The present invention can be defined, in general terms and considering one aspect thereof, as a holder for use in a display mounting system including a post having a predetermined cross-section and a pair of such holders for securing the post to a display panel. In broadest aspect, the holder is adapted to become secured to a normally generally upright post to thus define, when so secured, a transverse slot open in a normally generally vertical direction. The slot is complementary in width and shape with a first transverse edge of an associated display panel. The holder includes securement means adapted to fixedly but releasably secure the holder to an associated complementary post at a selectively adjustable level, whereby the holder can be used as one of a pair of holders clamping therebetween a display panel. While the aforesaid definition relates to an arrangement wherein the post is generally vertical, it will be appreciated that this embodiment, while preferred, can be easily substituted by one in which the supporting post would be generally horizontal. As mentioned above, however, the latter embodiment is not preferred as certain measures would have to be taken to secure the display panel from falling down through the supporting slots.

In another general aspect of the present invention, a display panel mounting system is provided which comprises (a) a normally generally upright post, including means for holding the post in a generally upright position; (b) a first holder adapted to become secured to said post to define, when so secured, a transverse slot open in a normally generally vertical direction generally parallel with the elongation of the post, said slot being complementary in width, and shape with a first transverse edge of an associated display panel; (c) a second holder adapted to complement the first holder and providing a second transverse slot for engagement with a second transverse edge of the associated panel at a level vertically spaced from said first transverse edge; and (d) securement means adapted to fixedly but releasably secure the first holder to the post at a selectively adjustable level whereby the mounting system has an improved versatility with respect to the height of the panel to be mounted.

The invention will now be described in greater detail by way of a simple embodiment, it being understood that a vast number of obvious equivalents exists which provide the same effect by different structural features.

BRIEF DESCRIPTION OF THE DRAWINGS

FIG. 5 is a bottom perspective of an alternative view similar to FIG. 3.

DETAILED DESCRIPTION

Figure 1:
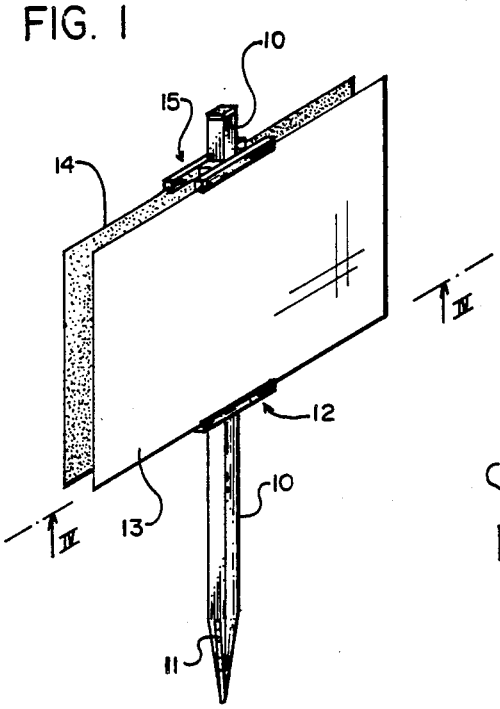
FIG. 1 presents a perspective view of a system according to the present invention as it appears in a completely assembled state, supporting two panels which are mounted flush with respect to each other.

Reference numeral 10 designates a post which, in the present case is a wooden post having a generally square cross-sectional configuration. The bottom of the post 10 is pointed and is provided with a pair of steel plates, only one of such plates, plate 11 being shown. The pointed end serves the purpose of anchoring the post 10 to the ground. FIG. 1 further shows that to the post 10 is fixedly secured a holder 12 which supports lower edges of two panels 13, 14. The sign panels 13, 14 are arranged flush relative to each other. That is to say, the panels are of identical contour, are each centered with respect to the post and are located at the same level. An upper holder 15 is of a generally identical configuration. It is secured to the post 10 and engages the panels 13, 14 in a way which will be described in greater detail as the specification proceeds.

Figure 2:
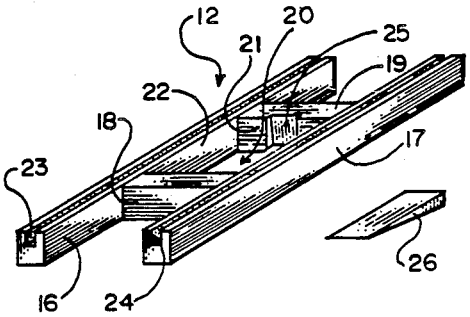
FIG. 2 is a top perspective view of a holder of the invention.
Figure 4:
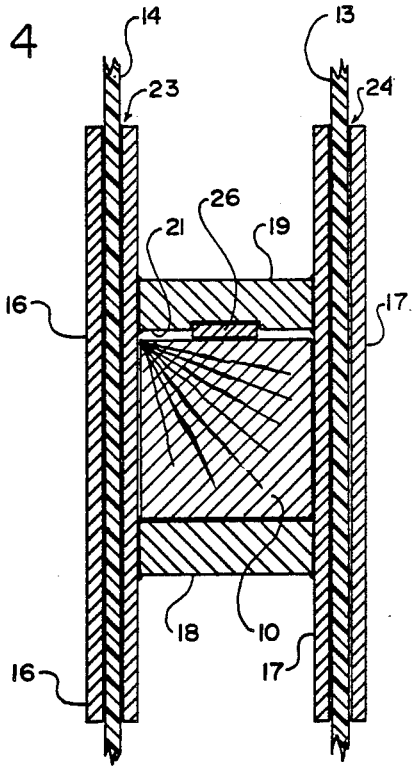
FIG. 4 is a view taken along the section line IV—IV of FIG. 1.
Figure 3:
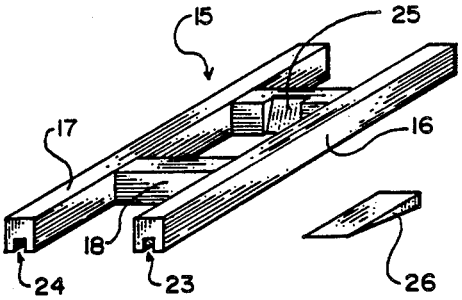
FIG. 3 is a bottom perspective view thereof.

The holders 12, 15 shown in FIGS. 2 and 3 are of identical configuration and are therefore described by using the same reference numerals.

Turning now to FIG. 2, the holder 12 is shown as including two transverse, elongated members 16, 17 and by two short spacers 18, 19. The members 16-19 are all made of steel and are welded together to form a generally integral unit. They define, at the center of the assembly, an opening 20. In particular, the opening is defined by an inside wall 21 formed by a portion of the spacer 19, by an end wall 22 formed by the transverse member 16 and by their opposed walls formed in a similar fashion by the transverse member 17 and by the spacer 18. The opening 20 is thus generally square shaped and is complementary with the cross-sectional configuration of the post 10, such that the entire holder 12 can be freely placed over the post and can slide along the post to be positioned at an appropriate level. The two transverse members 16, 17 are each provided with a continuous, straight, longitudinal slot 23, 24, respectively. The slots 23 and 24 are straight and are open at each end of the respective transverse member 16, 17 so that they can hold only a part (usually central) of the edge of the associated panels 14, 13, as shown. What is important is that the holder 12 allows the clasping or clamping of the panels 13, 14 at the center of their lower most edges.

In order to fixedly but releasably secure the holder 12 to the post 10, the shown embodiment is provided with a wedge receiving groove 25 in the side wall 21. The groove 25 is open both at the top surface of the longitudinal member 19 visible in FIG. 2 and at the bottom surface or opposite end of the opening 20 which is visible in FIG. 3. The groove 25 is complementary with a wedge 26. The wedge 26 is sufficiently longer than the length of the opening 20 as measured from one end thereof to the other. The size of the groove 25 and of the wedge 26 is made such that with the wedge placed in the groove 25 and in firm engagement with the post 10, a part of the wedge 26 protrudes downwardly below the holder 12 as seen in FIG. 2 while the narrow end of the wedge protrudes upwardly, above the top surface of the spacer 19. Accordingly, with the holder 12 positioned over the post 10,all one has to do is drive the wedge 26 through the wedge receiving groove 25 to secure a tight hold of the post within the opening 20. Once the lower holder 12 is in place, the display panels 13, 14 can be placed into the grooves 23, 24 and temporarily held in place by the top holder, reference number 15, for convenience referred to as "a first holder 15" as it is physically located above the aforesaid holder 12, the holder 12 therefore being referred to as "a second holder 12".

In the shown embodiment, the first holder 15 is of an identical configuration as that of the second holder 12. However, when placed on the post, the orientation of its respective slots 23, 24 is reversed. Instead of being open upwardly, they face downwardly in order to clamp the upper edges of the planar panels 13 and 14. When the first holder 15 is engaged with the panels, the first holder 15 is fixed to the post 10 by driving another wedge 26 (FIG. 3) into the space of the respective wedge receiving groove 25 in exactly the same fashion as in securement of the holder 12.

In the FIG. 5 alternative the holder is similar to that shown in FIGS. 1–4 except that it has no groove 25, instead the entire inside wall 21 of spacer 19 is at an angle complementary with the wedge rather than just a relatively narrow groove 25.

The assembly and disassembly of the sign holder as described above is an easy task. The components of the entire assembly are very easy to store, for instance in the trunk of a small car which is of a particular practical advantage. Another advantage is in that the simple structural arrangement of the components allows mass production from metal, from plastic material, from wood or from any other suitable material or combinations thereof.

Those skilled in the art will readily appreciate that the described embodiment can be modified to a very substantial degree without departing from the spirit and scope of the present invention. Strictly as one of many examples only, one can visualize the holders to be adapted to hold circular or elliptic signs with their respective slots shaped accordingly. The securement of the holders to the post can be done in a vast number of different ways utilizing, for instance, a clamp, a set screw or the like. Another modification that comes readily to mind would be a regular U-shaped yoke which would be driven through the wall of the front member 16. In the preferred embodiment, the arrangement is adapted to hold two panels in flush arrangement as described. This is not to say, however, that the arrangement could not be made for just a single panel as the physical securement of only a counterpart of the transverse member 16 or the like structural element to the post 10 is not a difficult task. Similarly, the cross-sectional configuration of the post can vary from plain circular cross-section which would usually be associated with a metallic tube, to all kinds of relatively complex cross-sectional configurations typical for extrusion moulded elements.

Accordingly, while the above embodiment is believed to be the simplest and most effective arrangement, particularly for combination with a wooden post of rectangular cross-sectional configuration, a vast number of modifications departing to a relatively substantial degree from the above embodiment would still fall within the scope of the present invention.

Accordingly, I wish to include within the scope of the present invention arrangements which may differ from the described embodiment but which would still fall within the scope of my contribution to the art.

I claim:

1. A display panel mounting system comprising:

(a) a normally generally upright post provided with support means for holding the post in a generally vertical position;

(b) a first holder including a sleeve portion of a cross-section complementary with that of a post to allow a sliding displacement of the holder along the post, and frictional securement means operatively associated with the sleeve portion to firmly press a section thereof against the surface of the post to frictionally clamp the respective sleeve portion to the post, said sleeve being generally integral with a pair of transverse members parallel with each other and being disposed one to each side of the post, each transverse member defining a transverse slot which, when the sleeve is secured to the post, is open in a generally vertically upward direction;

(c) a second holder of a structure and size generally identical with that of said first holder, said second holder being so arranged, when secured to the post, that the transverse slots thereof are parallel with the transverse slots of the first holder and are open in a generally vertically downward direction, toward the respective upwardly open slot of the first holder, whereby two display panels, one to each side of the post, can be held in the respective slots of the first and second holders, (d) the frictional securement means of each holder including a camming member disposed near that portion of the respective sleeve which extends between the respective pair of transverse members, whereby the camming member is accessible through a space between two panels held by the holders.

2. A display panel mounting system as claimed in claim 1, wherein said post is of a generally square cross-section two opposed sides of which are generally parallel with the transverse members, the camming member of each holder being a single wedge complementary with a portion of the respective sleeve facing that surface of the post which is perpendicular to the said two opposed sides of the posts whereby the clamping force exerted upon the sleeve is directed solely in the transverse direction generally parallel with said slots.

3. A system as claimed in claim 1, wherein each slot is straight and normally generally transversely elongated with respect to the post, when the respective holder is secured to the post.

4. A display panel mounting system for a normally generally upright post comprising:

(a) a first holder including a closed sleeve portion with an inner wall, said sleeve portion being of a cross-section complementary with that of a post to allow a sliding displacement of the holder along the post, and frictional securement means operatively associated with the sleeve portion to firmly press a section thereof against the surface of the post to frictionally clamp the respective sleeve portion to the post, said sleeve being generally integral with a pair of transverse members parallel with each other and being disposed one to each side of the post, each transverse member defining a transverse slot which, when the sleeve is secured to the post, is open in a generally vertically upward direction;

(b) a second holder of a structure and size generally identical with that of said first holder, said second holder being so arranged, when secured to the post, that the transverse slots thereof are parallel with the transverse slots of the first holder and are open in a generally vertically downward direction, toward the respective upwardly open slot of the first holder, whereby two display panels, one to each side of the post, can be held in the respective slots of the first and second holders, (c) the frictional securement means of each holder including a camming member having an inner surface and an outer surface and positioned within said sleeve portion so that one camming surface contacts the inner wall of the sleeve and the other camming surface contacts the post upon which the respective holder is positioned.

* * * * *